United States Patent [19]

Blair

[11] 4,405,068

[45] Sep. 20, 1983

[54] PORTABLE ROLL-RIDING TAPE CUTTER

[76] Inventor: Bruce A. Blair, 720 W. California Ter., Chicago, Ill. 60657

[21] Appl. No.: 277,229

[22] Filed: Jun. 25, 1981

[51] Int. Cl.[3] ..... B65D 85/671; B26D 1/02

[52] U.S. Cl. ..... 225/65; 225/66

[58] Field of Search ..... 225/65, 66, 56

[56] References Cited

U.S. PATENT DOCUMENTS

| | | | |
|---|---|---|---|
| 2,401,286 | 5/1946 | Wright | 225/66 X |
| 3,134,526 | 5/1964 | Schleicher | 225/65 X |
| 3,378,184 | 4/1968 | Mallory | 225/66 |
| 3,684,141 | 8/1972 | Hall | 225/65 |
| 3,904,095 | 9/1975 | Doyle | 225/56 |

FOREIGN PATENT DOCUMENTS

| | | | |
|---|---|---|---|
| 934103 | 5/1948 | France | 225/65 |

*Primary Examiner*—Frank T. Yost

*Attorney, Agent, or Firm*—Hill, Van Santen, Steadman & Simpson

[57] ABSTRACT

A portable roll-riding tape cutter comprises two cooperative collapsibly interengageable members, one of which engages with the outer perimeter of the tape roll and the other of which engages with the inner diameter of the ring-shaped core of the roll. Telescopically engageable legs on the members straddle the sides of the roll and are equipped with complementary separably interdigitating retaining ribs. One or both of the members may be provided with curved bearing surfaces substantially matching the roll surface curvature to facilitate maximum severed tape strip utilization from the roll by use of the assembly. Clearance recesses in the legs facilitate digital manipulation and improve the resiliency of the leg. Channels on the legs of one of the members and complementary base bars on the other of the members carry the interdigitating retaining ribs and also maintain the members against displacement relative to one another circumferentially of the roll.

17 Claims, 9 Drawing Figures

PORTABLE ROLL-RIDING TAPE CUTTER

This invention relates to improvements in tape cutters especially adapted for use with rolls of tape, such as masking tape, wound on relatively large diameter ring-shaped cores, and is more particularly concerned with portable cutters adapted to ride on and with the respective rolls with which used.

Portable roll-riding tape cutters of numerous and varied forms have heretofore been proposed, but apparently with little or no commercial success due to various deficiencies such as complexity of structure, costly construction, lack of adaptability to diminishing roll size as the tape continues to be dispensed, inadequate conformity to roll surfaces, and the like. A device subject to at least some of the deficiencies mentioned is disclosed in U.S. Pat. No. 3,904,095, and although such device is quite simple, it will not permit complete utilization of tape on a roll because of a tendency of the parts to bind as the roll reaches a diminished but yet useful diameter.

An important object of the present invention is to provide a new and improved portable roll-riding tape cutter which will overcome the disadvantages, drawbacks, inefficiencies, short comings and problems adherent in prior devices of this type.

Another object of the invention is to provide a new and improved tape cutter assembly which is simple in structure, convenient to use, in which the parts effectively maintain their cooperative relationship in use, and which will facilitate maximum severed tape strip utilization from the tape rolls.

In an embodiment of the invention there is provided in a tape cutter assembly having a pair of complementary collapsibly interengageable members adapted to receive therebetween and ride circumferentially about an annular roll of tape wound on a ring-shaped core, to position an edge on one of the members across the roll perimeter for severance of selective terminal lengths of tape stripped from the roll and manipulated into severing relation to the edge, telescopically engageable legs on the members for straddling the sides of the roll and equipped with complementary separably interdigitating retaining ribs for holding the members in assembly against unintentional separation from one another radially relative to the roll, there being means cooperating with the retaining ribs for maintaining the members against displacement relative to one another circumferentially of the roll, and curved bearing surface means on at least one of the members substantially matching roll surface curvature to facilitate maximum severed tape strip utilization from the roll by use of the assembly.

The construction and relationship of parts of the tape cutter assembly are desirably such as to permit reverse assembly in a relationship wherein highest efficiency is attained in one assembled orientation of the members while the tape roll is in a large diameter range, and when the roll has diminished to a smaller diameter range, the reversal of the parts with respect to one another enables served tape strip utilization down to the central roll supporting ring shaped core.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
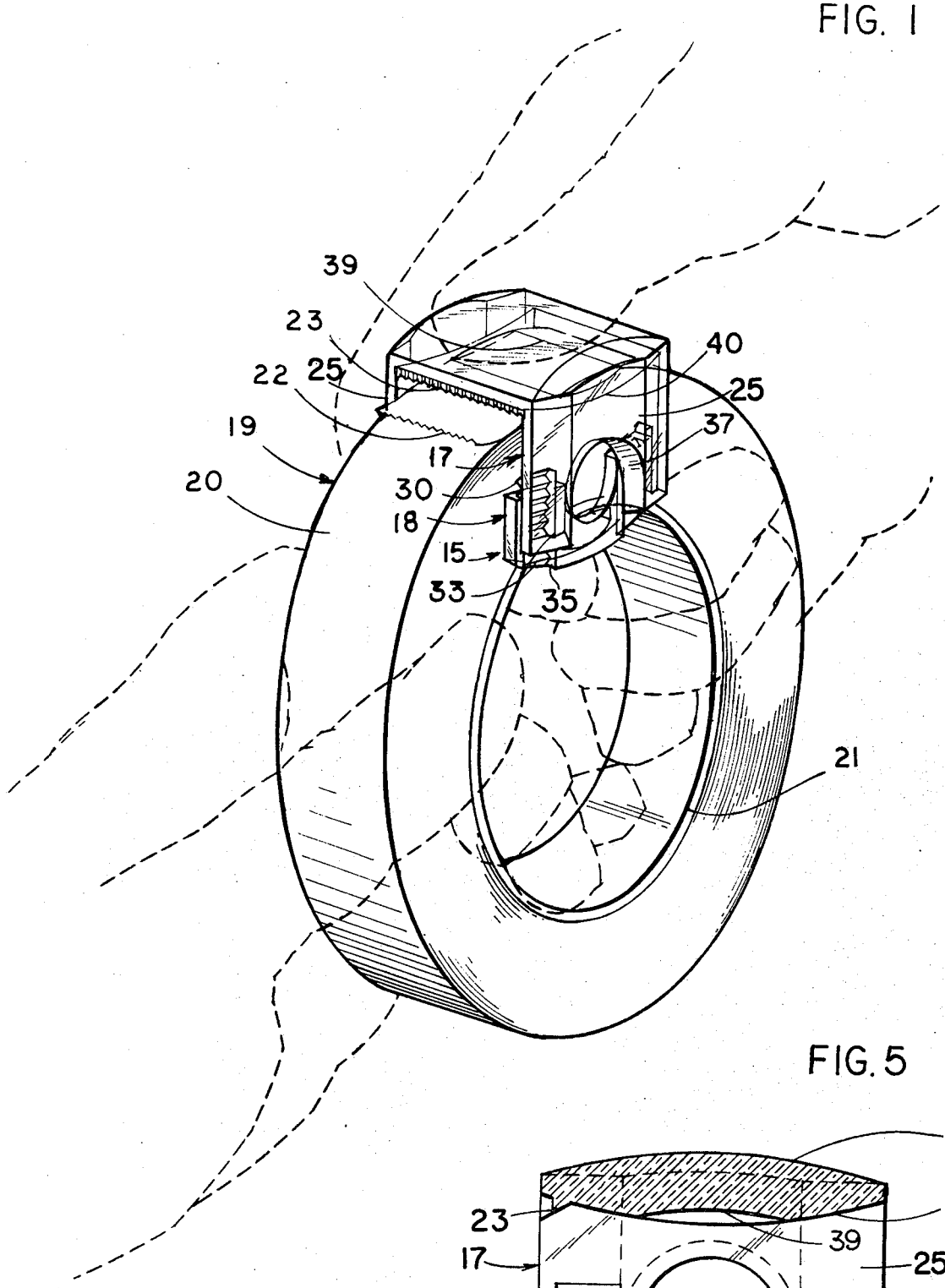
FIG. 1 is a perspective view showing a tape cutter assembly embodying the invention mounted on a roll of tape to be dispensed by severed lengths utilizing the tape cutter assembly.

As shown in FIG. 1, a taper cutter assembly 15 has a pair of complementary collapsibly interengageable members 17 and 18 adapted to receive therebetween and ride circumferentially about an annular roll 19 of tape 20 wound on a ring-shaped core 21. The device 15 is adapted to be manipulated by one hand of the user while the other hand of the user holds the roll 19 for backing the device 15 circumferentially along the roll away from a loose terminal 22 of the tape 20 which is thereby exposed for grasping between the thumb and forefinger of the hand released from holding the roll 19 for thereby pulling on the terminal 22 until the desired length of tape has been stripped from the roll 19. It will be understood that the tape 20 is provided with a pressure sensitive adhesive backing and must be manipulatively stripped from the roll. Masking tape generally having a paper body, and heavier types of plastic body tapes will generally stand away from the underlying tape layer in the roll as shown at the terminal 22 in FIG. 1, after having been stripped, and this is an advantage in starting the stripping of a strip of the tape from the roll.

Figure 5:
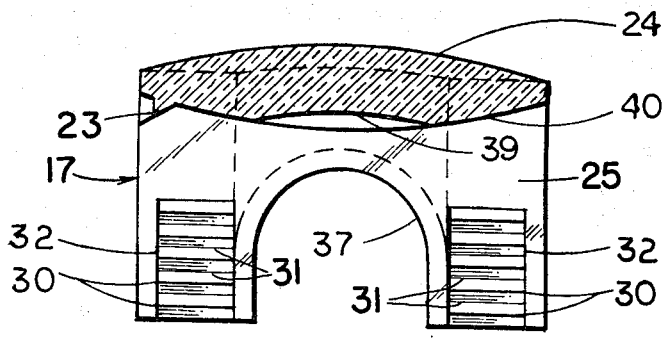
FIG. 5 is a sectional detail view taken substantially along the line V—V of FIG. 2.

In utilizing the tape cutter 15 in its roll-mounted operating condition, it is manipulatively backed away from the terminal 22, the terminal then being grasped between the thumb and forefinger of the user who pulls on the terminal while the cutter 15 is held against travelling with the roll which rotates through the cutter assembly until the desired length of tape strip has been pulled out. Detachment of the tape strip is then affect by a tilting maneuver against a severing edge 23 on the front edge of the number 17 and extending side-to-side across the width of the tape 20 and suitably spaced therefrom, so that at the same time the strip is severed the next succeeding raised tape starter terminal 22 is formed. A serrated form of the edge 23 is preferred, and the serrations desirably point generally toward the perimeter of the roll 19 as best seen in FIG. 5.

In a preferred construction, the cutter assembly members 17 and 18 comprise molded plastic units which may be transparent or opaque, and in any preferred color or combination of colors. For example, to differentiate the members for ready identification purposes, they may be differently colored or one, such as the member 17, may be transparent while the other member 18 is opaque. By having at least the member 17 transparent, the exact relationship of the cutting assembly relative to the tape roll on which mounted can be readily visualized. In any event, the members 17 and 18 are constructed and arranged to be separably interengaged on and about the associated tape roll. For this purpose, the member 17 has a body 24 which is adapted to overlie the outer perimeter of the tape roll. At its opposite sides, the body 24 has integrally therewith respective substantially mirror image legs 25 which are adapted to straddle the sides of the associated tape roll. The member 18 has a body 27 adapted to extend across the perimeter of the core 21 of the associated tape roll 19, with respective, substantially mirror image legs 28 adapted to straddle the sides of the roll. In this instance, the legs 28 are adapted to engage the sides of the roll slideably at their inner faces 29, while the legs 25 of the member 17 are adapted to engage telescopically with the outer sides of the legs 28. Although in the most economical form, as shown, the severing edge 23 is molded integrally with the body 24, if desired the edge 23 may comprise an inserted metal blade.

Means are provided for holding the members 17 and 18 in assembly against unintentional separation from one another both radially and circumferentially relative to the associated tape roll. For this purpose, the legs 25 of the member 17 are provided at their inner sides with taper-sided ribs 30 and intervening valleys 31 in ladder-like arrangement extending in respective series from adjacent to the distal ends of the legs. In a preferred orientation, each of the legs 25 has two sets of the ribs and valleys 30, 31, one located adjacent to one edge of the leg and the other located adjacent to the opposite edge of the leg, and each set projecting from and extending across a bar-like base 32 elongated in the direction of the extent of the series of ribs and valleys 30, 31.

Figure 3:
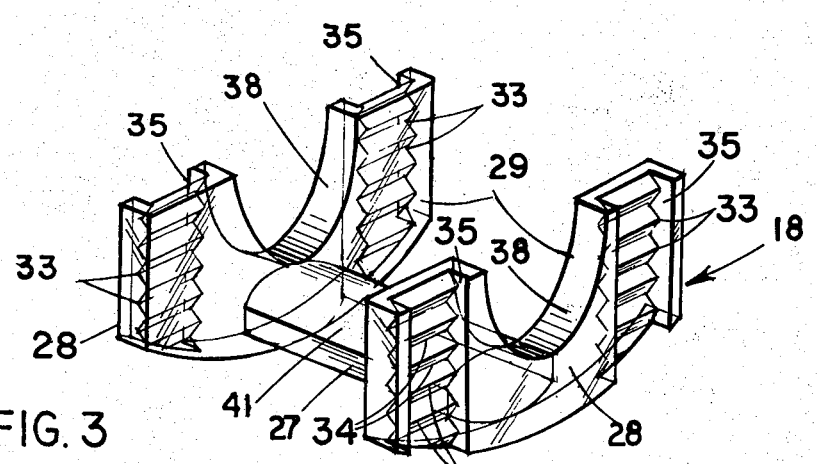
FIG. 3 is an enlarged perspective view of the roll inner diameter engaging member of the tape cutter assembly in one orientation relative to the outer diameter member of the assembly.
Figure 4:
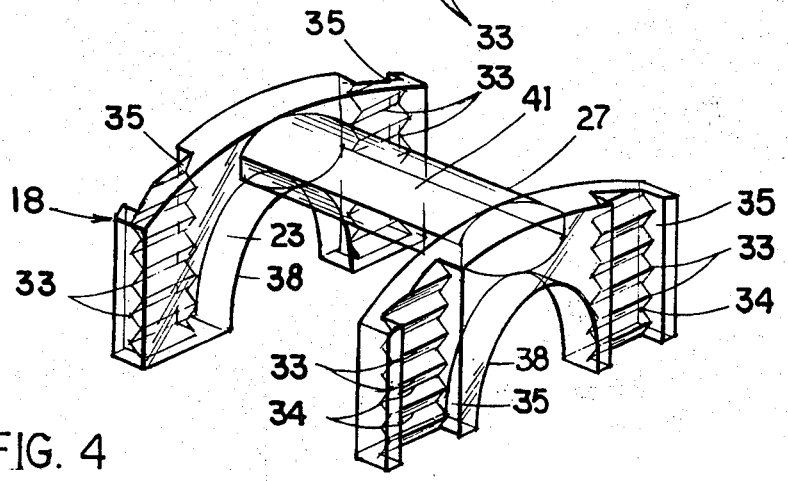
FIG. 4 is a perspective view of the member illustrated in FIG. 3 but showing it in another useful orientation relative to the outer perimeter tape cutter assembly member.

In complementary relation to the sets of ribs and valleys 30, 31 of the legs 25 of the member 17, the legs 28 of the member 18 have respective series or sets of taper-sided ribs 33 and valleys 34 adjacent to the respective opposite edges of the legs 28 but located in respective channels 35 complementary to and respective of the base bars 32. As seen in FIGS. 3 and 4, the channels 35 are open at both ends for reception of the base bars 32 by relative assembly movement from either of the channel ends. Through this arrangement, the cutter member 18 is adapted to be applied to the inside diameter of the tape roll 19, and the member 17 applied to the outside diameter of the tape roll with the base bars 32 aligned with the respective channels 35 and cooperating to guide the members 17 and 18 into proper matching assembly. By pressing the members 17 and 18 toward one another, the complementary ribs 30 of the member 17 are adapted to engage progressively in separable member-retaining relation. This is facilitated by the slant or taper sided form of the parallel ribs and by having the legs 25 sufficiently resiliently flexible to permit outward expansion and return as the respective retaining ribs 30 and 33 pass one another. Initially, the first interengaging ribs 30 and 33 may interengage snappingly. When the two parts 17 and 18 of the assembly come into engagement with respectively the outer perimeter and the inner perimeter of the tape roll after rib crests have passed one another but before advancing into the bottoms of the respective valleys, the tapered sides of the ribs will react cam-like to draw the members together until the roll thickness between the members diminishes to the point of full seating of the retaining ribs with one another. However, where the rib crests have not passed one another looseness of the members in a radial direction relative to the roll may be avoided by gradual take up through digital pressure on the member 17 and 18 toward one another until, as the thickness of the intervening roll diminishes, the crests of the ribs advance over one another into the next draw-up phase.

Not only is resilience of the retainer rib carrying portions of the legs 25 and 28 improved, but manipulation of the cutter device 15 in use is facilitated by having the legs 25 of the member 17 provided with respective central clearance recesses 37, and the legs 28 of the member 18 provided with substantially similar, matching central clearance recesses 38, in both instances opening through the distal ends of the legs. In a preferred form, the recesses 37 and 38 are of generally curved arch shape and are located equidistantly between the respective sets of retainer ribs which are thereby located on recess-separated relatively resiliently flexible portions of the legs.

Figure 2:
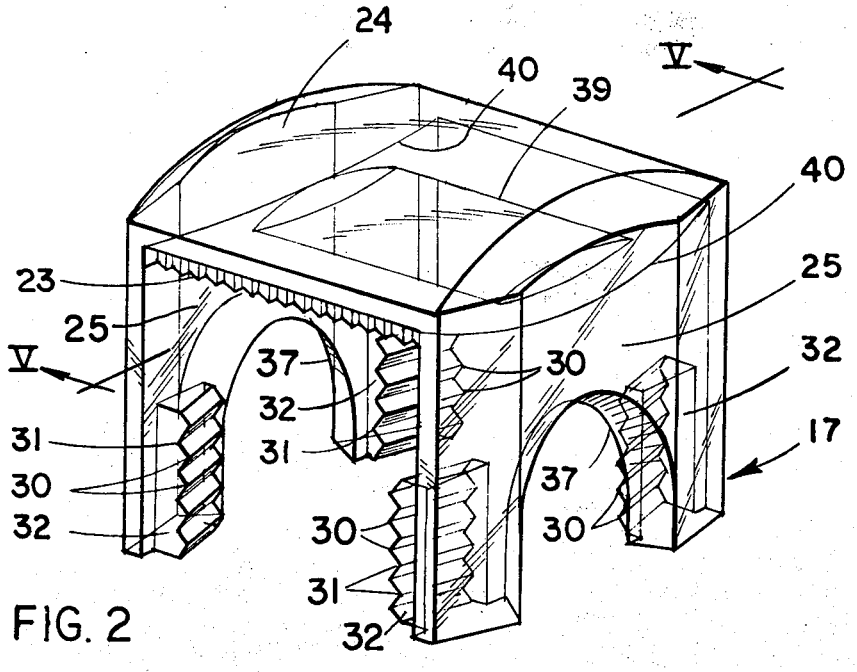
FIG. 2 is an enlarged perspective view of the outer roll perimeter engaging member of the tape cutter assembly.

Within any one size of roll width, tape rolls may have as much as ten percent width tolerance. Therefore, although the members 17 and 18 of the cutter 15 may be constructed to accomodate the maximum range of such tolerance, narrower ranges should also be accomodated without looseness of the device in sideward directions. For this purpose, automatic sideward take-up means are provided in respect to the legs 25 and 28 of the members and more particularly the portions of the legs at the opposite sides of the recesses 37 and 38. This is desirably effected by having the retainer ribs 30 of the member 17 tilted as best seen in FIG. 2 inwardly towards the outside edges of the base bars 32, so that on engaging the ribs 33 of the member 18, an inward thrust bias is imparted to the outer side edge areas of the legs 28. To facilitate resilient flexing of the side edge portions of the legs 28 about axis parallel to the channels 35, the body 27 is substantially narrower than the width of the legs 28 and located centrally of the width of the legs, substantially as shown. Through this arrangement, the smooth inner surfaces 29 of the legs 28 will maintain firm but moderate frictional grip on the sides of the tape roll 19.

The function of the cutter device 15 is improved with respect to maintaining smooth but effective frictional braking contact with the outer and inner perimeters of the tape roll 19 by the provision of properly located curved bearing surface means. In a desirable form, the bearing surface means comprises on the member 17 an arched, concave recess 39 in a roof surface 40 provided by the body 24, and the recess 39 substantially matching the radius of curvature of the roll 19. The width of the bearing recess 39 should be ample to accomodate the width of the roll 19 to be served by the cutter 15.

Convex curvature of the roof 40 provides a smoothly curved surface area leading especially to the severance edge 23 on the body 24. This facilitates stripping of the tape strip from the roll even though the roll perimeter is engaged in the recess 39. At each opposite end of the body 24, the upcurved, diminishing thickness of the body in line with the outer edges of the legs 25 provides a factor of improved resilience in those portions of the legs for their retaining function having regard to the tilted orientation of the retainer ribs 30. Nevertheless, the central portion of the body 24 being substantially thicker provides desirable structural rigidity for the body and stabilizes the legs 25.

Inner and outer respective convex bearing surfaces 41 are provided on the body 27 of the member 18, formed on radius of curvature and generally matching the radius of curvature of the inner diameter of the tape roll 19 and more particularly of the core 21. This enables reversal of the member 18 for functioning with equal efficiency having regard to the bearing engagement with the inner diameter of the roll.

Figure 6:
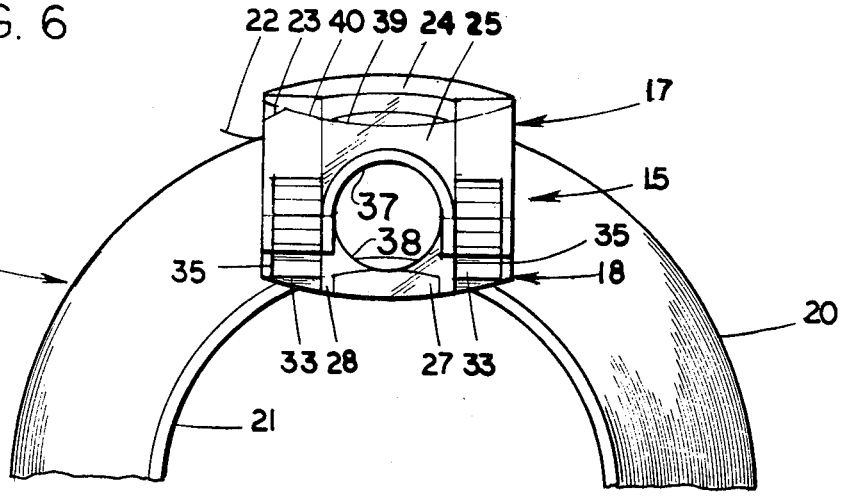
FIG. 6 is a fragmentary side elevational view showing the tape cutter assembly mounted on a full diameter tape roll.

FIGS. 6–9 demonstrate various phases in the use of the cutter device assembly 15. In FIG. 6, the assembly 15 is depicted as riding on the roll 19 while the roll is fully or nearly full so that it is at or near its maximum outside diameter. It will be observed that in this phase, the members 17 and 18 are oriented with the leg recesses 37 and 38 facing toward one another. It may also be noted that at this stage, the rows or series of retainer ribs 31 and 33 are only partially interengaged. Also, while the interengaged retainer ribs retain the members 17 and 18 against unintentional separation from one another radially relative to the roll 19, engagement of the base bars 32 in the grooves 35 will maintain the members 17 and 18 against displacement relative to one another circumferentially of the roll 19. The means to this end comprise the confronting surfaces defining the sides of the grooves 35 and the surfaces at the sides of the base bars 32.

Figure 7:
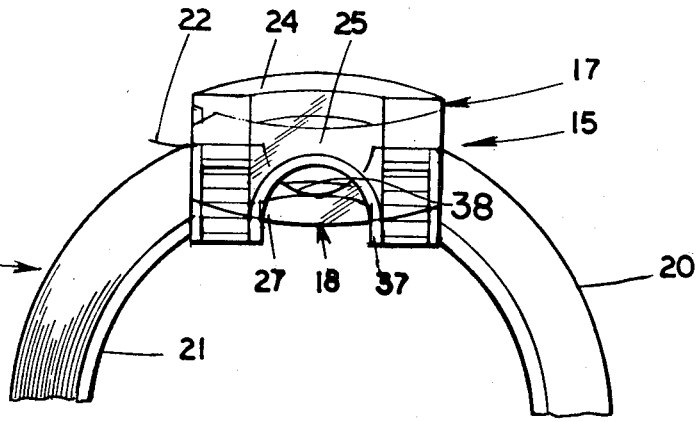
FIG. 7 is a view similar to FIG. 6 but showing the relationship of tape cutter assembly parts after the tape roll has reached a substantially diminished diameter.
Figure 8:
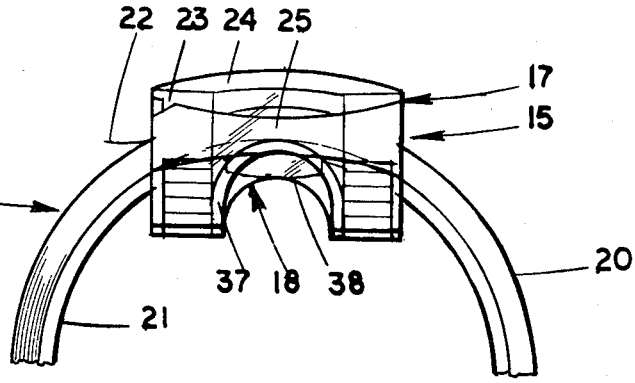
FIG. 8 is a similar view showing the parts of the tape cutter assembly relatively reversed to accommodate substantially diminished tape roll diameter.
Figure 9:
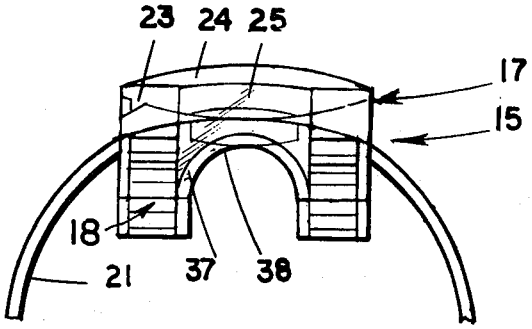
FIG. 9 is a similar view showing how the tape cutter assembly appears when the tape roll has been completely stripped.

As the outside diameter of the tape roll 19 diminishes, the telescopically related members 17 and 18 progressively telescope further as indicated in FIG. 7. Such telescoping may progress until the legs 25 and 28, respectively of the devices, bind as the limit of resilient flexibility of the legs 25 of the member 17 is reached. Thereupon the members 17 and 18 are pulled apart, and then reassembled on the diminished roll 19 by reversal of the member 18 relative to the member 17, substantially as indicated in FIG. 4 and FIG. 8. The pull-apart is facilitated by the recesses 37 and 38 in the legs of the members, which afford convenient finger holds. It may be noted that the recesses 37 of the member 17 are defined by outwardly flaring wall surfaces which facilitate digital manipulation. In the reversed relationship of the member 18 relative to the member 17, the exposed recesses 38 in the legs of the member 18 provide a convenient finger slot in which the index finger of the user is adapted to be engaged while manipulating the cutter assembly 15 on the roll. Upon depletion of the tape 20 from the ring-shaped core 21 of the roll, as indicated in FIG. 9, and wherein the member 18 may be fully telescoped into the member 17, so that the recesses 37 and 38 are substantially coincident, separation of the members 17 and 18 may be effected by grasping the member 17 in one hand and pulling radially inwardly away from the member 17 on the core 21 manipulated by the other hand to pull the member 18 free from the member 17. The cutter assembly 15 is then adapted to be reassembled on a fresh tape roll 19 to repeat the utilization process.

It will be understood that variations and modifications may be effected without departing from the spirit and scope of the novel concepts of this invention.

I claim as my invention:

1. In a tape cutter assembly having a pair of complementary collapsibly interengageable members adapted to receive therebetween and ride circumferentially about an annular roll of tape wound on a ring-shaped core, one of said members adapted to engage the outer diameter of the roll and the second of said members adapted to engage the inner diameter of the roll, an edge on said one member arranged to extend across the roll outer diameter for severance of selective terminal lengths of tape stripped from the roll and manipulated into severing relation against said edge, telescopically engageable legs on said members for straddling the sides of the roll and equipped with complementary separable interdigitating retaining ribs for holding the members in assembly against unintentional separation from one another radially relative to the roll, and means cooperating with said retaining ribs for maintaining said members against displacement relative to one another circumferentially of the roll, the improvement comprising:

said second member being reversible relative to said one member;

and oppositely convexly curved bearing surfaces on said second member substantially matching inside diameter roll surface curvature to facilitate maximum severed tape strip utilization from the roll by reversing said second member relative to said one member as the tape in the roll diminishes during use of the assembly.

2. An assembly according to claim 1, wherein said second member has channels within which the retaining ribs on said second member are located, and the complementary retaining ribs on the legs of the one of said members projecting into said channels, and said means for maintaining said members against displacement comprising surfaces projecting from said one member legs into said channels and cooperating with surfaces in said channels.

3. An assembly according to claim 2, wherein said retaining ribs on the legs of said one member are carried on base bars complementary to and fitting said channels and said projecting surfaces being on said base bars.

4. An assembly according to claim 2, wherein said channels are open at opposite ends whereby to enable said reversal of said second member relative to said one member.

5. An assembly according to claim 1, wherein said legs of both of the members have central recesses which separate the legs into relatively resiliently flexible portions, said retaining ribs being located on said separated leg portions.

6. An assembly according to claim 1, including means on the telescoped legs for pressing the innermost of the legs toward the sides of the roll.

7. An assembly according to claim 1, wherein the second of said members has a bar body which connects intermediate portions of, and is substantially narrower than, the legs of said second member so that portions of the legs of said second member projecting laterally from the bar body are adapted to flex resiliently relative to the bar body and to one another.

8. In a tape cutter assembly having a pair of complementary collapsibly interengageable members adapted to receive therebetween and ride circumferentially about an annular roll of tape wound on a ring-shaped core, to position an edge on one of said members across the roll perimeter for severance of selective terminal lengths of tape stripped from the roll and manipulated into severing relation against said edge, the improvement comprising:

telescopically engageable legs on said members for straddling the sides of the roll and equipped with complementary separable interdigitating retaining ribs for holding the members in assembly against unintentional separation from one another radially relative to the roll;

means cooperating with said retaining ribs for maintaining said members against displacement relative to one another circumferentially of the roll;

curved bearing surface means on at least one of said members substantially matching roll surface curvature to facilitate maximum severed tape strip utilization from the roll by use of the assembly;

one of said members having channels within which the retaining ribs on said one member are located, and the complementary retaining ribs on the legs of the other of said members projecting into said channels;

and said means for maintaining said members against displacement comprising surfaces projecting from said other member legs into said channels and cooperating with surfaces in said channels.

9. An assembly according to claim 8, wherein said retaining ribs on the legs of said other member are carried on base bars complementary to and fitting said channels and said projecting surfaces being on said base bars.

10. An assembly according to claim 9, wherein said channels are open at opposite ends whereby to enable reversal of said one member relative to said other member.

11. In a tape cutter assembly having a pair of complementary collapsibly interengageable members adapted to receive therebetween and ride circumferentially about an annular roll of tape wound on a ring-shaped core, to position an edge on one of said members across the roll perimeter for severance of selective terminal lengths of tape stripped from the roll and manipulated into severing relation against said edge, the improvement comprising:

telescopically engageable legs on said members for straddling the sides of the roll and equipped with complementary separably interdigitating retaining ribs for holding the members in assembly against unintentional separation from one another radially relative to the roll;

means cooperating with said retaining ribs for maintaining said members against displacement relative to one another circumferentially of the roll;

and central recesses in at least the legs of one of said members opening through the distal ends of these legs, so that portions of these legs separated by the recesses are relatively resiliently flexible, and the recesses facilitate digital manipulation of the assembly.

12. An assembly according to claim 11, wherein said retaining ribs are located on said portions of the legs separated by said recesses.

13. In a tape cutter assembly having a pair of complementary collapsibly interengageable members adapted to receive therebetween and ride circumferentially about an annular roll of tape wound on a ring-shaped core, to position an edge on one of said members across the roll perimeter for severance of selective terminal lengths of tape stripped from the roll and manipulated into severing relation against said edge, the improvement comprising:

telescopically engageable legs on said members for straddling the sides of the roll and equipped with complementary separably interdigitating retaining ribs for holding the members in assembly against unintentional separation from one another radially relative to the roll;

means cooperating with said retaining ribs for maintaining said members against displacement relative to one another circumferentially of the roll, comprising:

the legs of one of said members having channels therein and the retaining ribs on said one member being located in said channels;

and means on the legs of the other of said members providing base bars complementary to said channels and having thereon the retaining ribs on the legs of said other of said members.

14. In a tape cutter assembly having a pair of complementary collapsibly interengageable members adapted to receive therebetween and ride circumferentially about an annular roll of tape wound on a ring-shaped core, to position an edge on one of said members across the roll perimeter for severance of selective terminal lengths of tape stripped from the roll and manipulated into severing relation against said edge, the improvement comprising:

telescopically engageable legs on said members for straddling the sides of the roll and equipped with complementary separable interdigitating retaining ribs for holding the members in assembly against unintentional separation from one another radially relative to the roll;

means cooperating with said retaining ribs for maintaining said members against displacement relative to one another circumferentially of the roll;

curved bearing surface means on at least one of said members substantially matching roll surface curvature to facilitate maximum severed tape strip utilization from the roll by use of the assembly;

and means on the telescoped legs for pressing the innermost of the legs toward the sides of the roll.

15. In a tape cutter assembly having a pair of complementary collapsibly interengageable members adapted to receive therebetween and ride circumferentially about an annular roll of tape wound on a ring-shaped core, to position an edge on one of said members across the roll perimeter for severance of selective terminal lengths of tape stripped from the roll and manipulated into severing relation against said edge, the improvement comprising:

telescopically engageable legs on said members for straddling the sides of the roll and equipped with complementary separable interdigitating retaining ribs for holding the members in assembly against unintentional separation from one another radially relative to the roll;

means cooperating with said retaining ribs for maintaining said members against displacement relative to one another circumferentially of the roll;

and curved bearing surface means on at least one of said members substantially matching roll surface curvature to facilitate maximum severed tape strip utilization from the roll by use of the assembly;

said other of said members having a bar body which connects intermediate portions of, and is substantially narrower than, the legs of said other member so that portions of the legs of said other member projecting laterally from the bar body are adapted to flex resiliently relative to the bar body and to one another.

16. An assembly according to claim 15, including means on the telescoped legs for pressing the innermost of the legs toward the sides of the roll.

17. In a tape cutter assembly having a pair of complementary collapsibly interengageable members adapted to receive therebetween and ride circumferentially about an annular roll of tape wound on a ring-shaped core, to position an edge on one of said members across the roll perimeter for severance of selective terminal lengths of tape stripped from the roll and manipulated into severing relation against said edge, the improvement comprising:

telescopically engageable legs on said members for straddling the sides of the roll and equipped with complementary separable interdigitating retaining ribs for holding the members in assembly against unintentional separation from one another radially relative to the roll;

means cooperating with said retaining ribs for maintaining said members against displacement relative to one another circumferentially of the roll;

and curved bearing surface means on at least one of said members substantially matching roll surface curvature to facilitate maximum severed tape strip utilization from the roll by use of the assembly;

said legs of both of the members having central recesses which separate the legs into relatively resiliently flexible portions;

said retaining ribs being located on said separated leg portions.

* * * * *